United States Patent [19]

King

[11] 4,157,286

[45] Jun. 5, 1979

[54] PRODUCTION OF 1,2-BIS(HYDROXYPHENYL)ETHANE-1,2-DIOLS BY ELECTROLYTIC REDUCTION

[75] Inventor: Christopher J. H. King, Pensacola, Fla.

[73] Assignee: Monsanto Company, St. Louis, Mo.

[21] Appl. No.: 893,219

[22] Filed: Apr. 4, 1978

[51] Int. Cl.[2] ..... C25B 3/10; C25B 15/08

[52] U.S. Cl. ..... 204/73 R; 204/75; 204/77

[58] Field of Search ..... 204/73 R, 75, 76, 72, 204/77

[56] References Cited

U.S. PATENT DOCUMENTS 4,087,336 5/1978 Wagenknecht ..... 204/75

FOREIGN PATENT DOCUMENTS 656661 1/1963 Canada ..... 204/75

OTHER PUBLICATIONS

Shima, Coll. Sci. Kyoto Imp. Univ. [A]11, 407–418, (1928), Chemical Abstracts, vol. 23, p. 2371 (1929).

*Primary Examiner*—F. C. Edmundson

*Attorney, Agent, or Firm*—Thomas Y. Awalt, Jr.

[57] ABSTRACT

The product 1,2-bis(hydroxyphenyl)ethane-1,2-diol of electrolytic reductive coupling of hydroxybenzaldehyde is recovered by maintaining the electrolyte solution at a pH at which the product diol 1,2-bis(hydroxyphenyl)ethane-1,2-diol, precipitates out leaving the hydroxybenzaldehyde in solution, and continuously or intermittently filtering to collect the product diol.

7 Claims, 1 Drawing Figure

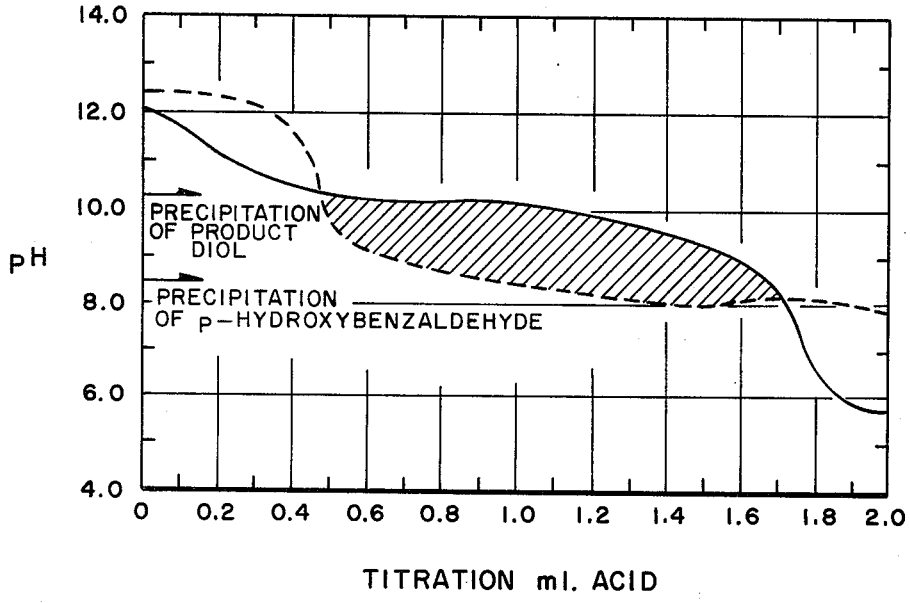
14.0
12.0
10.0
8.0
6.0
4.0
pH
PRECIPITATION OF PRODUCT DIOL
PRECIPITATION OF p-HYDROXYBENZALDEHYDE
0
0.2
0.4
0.6
0.8
1.0
1.2
1.4
1.6
1.8
2.0
TITRATION ml. ACID

PRODUCTION OF 1,2-BIS(HYDROXYPHENYL)ETHANE-1,2-DIOLS BY ELECTROLYTIC REDUCTION

BACKGROUND OF THE INVENTION

1. Field of the Invention

The invention relates to the electrolytic reduction of hydroxybenzaldehydes to produce the corresponding 1,2-bis(hydroxyphenyl)ethane-1,2-diol (dihydroxybenzoin). More particularly, the invention relates to the electrolytic reductive coupling of hydroxybenzaldehydes by electrolysis in an aqueous electrolysis medium in an undivided electrolytic cell to produce 1,2-bis(hydroxyphenyl)ethane-1,2-diols, and to the recovery of the product diol.

2. The Prior Art

Electrolytic reductive coupling of hydroxybenzaldehydes to prepare the corresponding 1,2-bis(hydroxyphenyl)ethane-1,2-diols has previously been accomplished in good yields. See, for example, Grimshaw et al., *Journal of the Chemical Society* (C), 653 (1966). However, each of the methods described in the prior art employed a divided cell. A divided cell is inherently more complex than an undivided cell, thereby involving higher costs in cell construction. A divided cell exhibits a higher internal resistance than an undivided cell resulting in substantially higher power costs. Efforts to adapt such divided-cell electrolytic methods of preparing 1,2-bis(hydroxyphenyl)ethane-1,2-diols to commercial production on a large technical scale have been severely limited by the above considerations.

One of the difficulties initially encountered in the use of undivided cells for such electrolytic reductive coupling was that recovery of the product diol from the electrolytic solution was cumbersome, slow, and in practice resulted in destruction of the effectiveness of the electrolyte solution from which the product diols were extracted.

A practical combination of a workable undivided cell electrolytic reductive coupling process for the preparation of 1,2-bis(hydroxyphenyl)ethane-1,2-diol with an effective recovery of the diol in such a manner as to permit reuse or continued use of the solution from which the product diol is recovered, would be a significant advance in the art and is an object of this invention.

SUMMARY OF THE INVENTION

The invention is an improvement in a process for the electrolytic reductive coupling of hydroxybenzaldehydes to produce the corresponding 1,2-bis(hydroxyphenyl)ethane-1,2-diol by electrolyzing in an undivided reaction cell an aqueous electrolyte solution of the hydroxybenzaldehyde to be coupled. The aqueous solution is in contact with a cathodic surface having a cathode potential sufficient for electrolytic reduction of the hydroxybenzaldehyde. The improvement lies in maintaining the aqueous electrolyte solution (within workable weight concentrations of the hydroxybenzaldehyde) at a pH below the pH at which the 1,2-bis(hydroxyphenyl)ethane-1,2-diol precipitates from the solution and above which the hydroxybenzaldehyde precipitates. The solution and precipitate are then filtered to collect the 1,2-bis(hydroxyphenyl)ethane-1,2-diol. The process may be continuous or semi-continuous; and of course filtration may be continuous or intermittent. In a continuous process the pH is maintained at a fairly constant rate by replenishing the hydroxybenzaldehyde being depleted in electrolytic reduction with fresh hydroxybenzaldehyde at an addition rate substantially the same as the depletion rate.

I have discovered that within workable concentration ranges of a hydroxybenzaldehyde electrolyte solution, there is a pH differential of about 2 (ranging in most cases from a pH of about 8 to a pH of about 10), within which the electrolytic reduction product diol will precipitate and the hydroxybenzaldehyde will not precipitate. This discovery and the observation of the workability of the reaction within the bounds of the discovery constitute the essence of this invention.

In the specification, reference will be made to the attached Drawing wherein the FIGURE depicts the relative points at varying pH at which the product diol and the hydroxybenzaldehyde will precipitate.

DETAILED DESCRIPTION OF THE INVENTION

Electrolytic reductive coupling of hydroxybenzaldehydes in an undivided cell produces 1,2-bis(hydroxyphenyl)ethane-1,2-diols.

In accordance with the present process, an electric current is passed through an aqueous alkaline electrolysis medium comprising the hydroxybenzaldehyde and aqueous solvent in an undivided cell.

The hydroxybenzaldehydes suitable for use in the present process are represented by the formula:

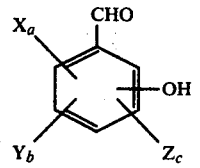

wherein X represents alkyl of 1 to 6 carbon atoms; Y represents alkoxy containing an alkyl of 1 to 6 carbon atoms; Z represents any non-interfering substituent, excluding alkyl and alkoxy; and a, b, and c each independently represent an integer from 0 (zero) to 4, inclusive, with the proviso that the sum of a, b, and c does not exceed 4.

The term "non-interfering substituent" is employed herein to mean a substituent which can be present in the hydroxybenzaldehyde without causing substantial adverse alteration of either the course of the desired reductive coupling of such hydroxybenzaldehydes or the yield of the desired product under process conditions.

Representative of hydroxybenzaldehydes suitable for use in the present process are 2-hydroxybenzaldehyde (o-hydroxybenzaldehyde, 3-hydroxybenzaldehyde (m-hydroxybenzaldehyde), 4-hydroxybenzaldehyde (p-hydroxybenzaldehyde), 2-hydroxy-3-methylbenzaldehyde, 3-hydroxy-5-methylbenzaldehyde, 4-hydroxy-3-methylbenzaldehyde, 2-hydroxy-3-ethylbenzaldehyde, 3-hydroxy-5-ethylbenzaldehyde, 4-hydroxy-3-ethylbenzaldehyde, 2-hydroxy-3-n-butylbenzaldehyde, 3-hydroxy-5-n-butylbenzaldehyde, 4-hydroxy-3-n-butylbenzaldehyde, 2-hydroxy-3-i-butylbenzaldehyde, 3-hydroxy-5-i-butylbenzaldehyde, 4-hydroxy-3-i-butylbenzaldehyde, 2-hydroxy-3-n-hexylbenzaldehyde, 3-hydroxy-5-n-hexylbenzaldehyde, 4-hydroxy-3-n-hexylbenzaldehyde, 2-hydroxy-3-methoxybenzaldehyde, 3-hydroxy-5-methoxybenzaldehyde, 4-hydroxy-3-methoxybenzaldehyde (vanillin), 2-hydroxy-3-ethoxybenzaldehyde, 3-hydroxy-5-ethoxybenzaldehyde, 4-hydroxy-3-ethoxybenzaldehyde, 2-hydroxy-3-n-butoxy-benzaldehyde, 3-hydroxy-5-n-butoxybenzaldehyde, 4-hydroxy-3-n-butoxybenzaldehyde, 2-hydroxy-3-n-hexoxybenzaldehyde, 3-hydroxy-5-n-hexoxybenzaldehyde, 4-hydroxy-3-n-hexoxybenzaldehyde, 2-hydroxy-3-methoxy-5-methylbenzaldehyde, 4-hydroxy-3-methoxy-5-methylbenzaldehyde, and the like. Of these, 4-hydroxybenzaldehyde is particularly important in that the coupled product therefrom 1,2-bis-(4-hydroxyphenyl)ethane-1,2-diol (4,4'-dihydroxyhydrobenzion), can readily be converted to 1,2-bis-(4-hydroxyphenyl)ethane which is very useful as an antioxidant and as a symmetrical bifunctional intermediate in the preparation of epoxy resins, polycarbonates, polyesters, and the like. It is, of course, apparent that the corresponding products from other suitable hydroxybenzaldehydes may be similarly employed even though they may not be symmetrical.

In carrying out the present process, a hydroxybenzaldehyde is charged to an undivided electrolytic cell fitted with a cathode and an anode, and an electromotive force is impressed upon the cell whereby the hydroxybenzaldehyde undergoes electrolytic reductive coupling to yield a 1,2-bis (hydroxyphenyl)ethane-1,2-diol in which the coupling occurs at the aldehyde functionality. The reaction involved can be illustrated as follows:

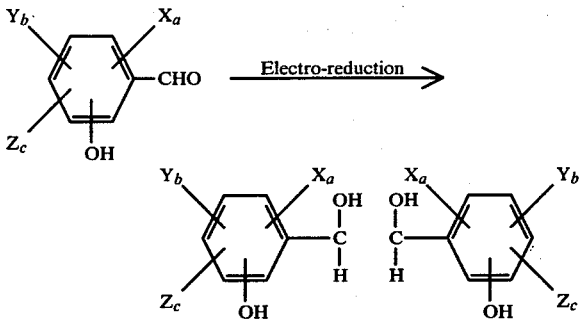

wherein X, Y, and Z, and a, b, and c are as defined hereinabove.

The electrolysis is carried out in an aqueous electrolysis medium having a pH below the pH at which the 1,2-bis(hydroxyphenyl)ethane-1,2-diol precipitates from the solution and above which the hydroxybenzaldehyde precipitates. There is, as shown in the FIGURE, between the pH of about 8 and about 10.3, a definitely defined area wherein there is a pH differential of about 2 within which this electrolytic reduction process can be conveniently operated. Referring to the FIGURE, it is the shaded area within which the process may be so operated. For example, if the product diol precipitates at a pH of 10, the hydroxybenzaldehyde will precipitate at a pH of about 8.3. In a system where the product diol precipitates at 10, an ideal pH range for operating the electrolytic reduction process would be at a point midway between the two precipitation points or at a pH of about 9.2.

The concentration of the hydroxybenzaldehyde compound in the electrolyte solution is not critical within convenient working ranges for the process to which this invention is limited. Concentrations of 2–10 wt % are workable. A concentration of 6–10 wt % is preferred. In batch reactions it is desirable to start at the highest workable concentration because the concentration decreases as the hydroxybenzaldehyde is electrolytically coupled.

The temperature at which the process of the instant invention is conducted is not narrowly critical and can range from as low as 9° C. to as high as 80° C. As is apparent to those skilled in the art, at lower temperatures a very dilute solution must be employed since the solubility of the hydroxybenzaldehyde starting material is lower at lower temperatures. For this reason, it is generally preferred to employ temperatures between about 20° C. and about 60° C., and usually between about 25° C. and about 50° C.

The current densities employed in the process of the present invention can range from as low as 0.001 ampere (1.0 milliampere) per square centimeter to 0.5 amperes (500 milliamperes) per square centimeter of cathode surface area.

The type of electrolytic cell employed in the process of the instant invention is not critical provided adequate mixing and circulation can be maintained. One or more free-standing anodes and cathodes may be connected to a source of direct electric current such as a battery and the like. The cell can also consist of one or more sets of two electrodes separated by an insulator such as a rubber or other non-conducting gasket or spacer. In such a cell, which is conveniently described as a "sandwich-type" electrolytic cell, the electrolysis medium is preferably flowed pass the (two) parallel electrodes (cathode and anode) in a recirculating system. Such an arrangement allows large volumes of the electrolysis medium to be effectively subjected to electrolysis in a relatively small cell having the preferred closely-spaced electrode surfaces.

The electrodes, that is, the anode and cathode, employed in the process of the present invention can be constructed of a wide variety of conductive materials. Thus, anode materials suitable for use in the present process include, for example, steel, lead (IV) oxide, noble metal oxide, carbon, graphite, and the like, with steel generally being preferred because of its greater stability against corrosion. Anodes comprising noble metal oxides are commonly known as "dimensionally stable (DSA) anodes".

The cathodes can also be of any conductive substances so long as such substances do not cause, to any significant extent, undesired side reactions, such as reduction of the aldehyde functionality to the corresponding alcohol functionality. For example, lead, cadmium, and mercury cathodes are suitable.

The inorganic bases which can be employed to render the aqueous electrolysis medium alkaline or basic include the alkali metal oxides and hydroxides such as, for example, sodium, potassium, rubidium, and cesium oxides and hydroxides.

In general, the alkali metal hydroxides, for example, sodium hydroxide, are preferred for use as the base in the present process for economic reasons. However, it will be recognized that in certain instances the quaternary ammonium hydroxides might be preferred due to the greater solubility of the hydroxybenzaldehydes in such solution.

The aqueous alkaline electrolysis medium must have sufficient conductivity to support the electrolysis current. While media of less than ideal conductivity can be employed, it is preferred from an economic viewpoint not to have too high a resistance. The conductivity can, if desired, be enhanced by the addition of common supporting electrolytes such as electrolyte salts having sufficiently high discharge potentials to the aqueous alkaline electrolysis medium. In general, however, with the combination of hydroxybenzaldehyde, base, and aqueous solvent employed in the present process, the addition of a supporting electrolyte to the electrolysis medium is not actually necessary or even desirable.

The term "supporting electrolyte" as employed herein is an electrolyte capable of carrying electric current but not discharging under electrolysis conditions. It will be recognized, of course, that discharge potentials will vary with electrode materials and their surface conditions and various materials in the electrolysis medium.

The term "salt" is employed in its generally recognized sense to indicate a compound composed of a cation and an anion, such as produced by the reaction of an acid with a base.

The supporting electrolytes which can be employed to enhance the conductivity of the aqueous alkaline electrolysis medium include alkali metal and quaternary ammonium phosphates, perchlorates, carbonates, tetrafluoroborates, hexafluorophosphates, and the like. Specific examples of such supporting electrolytes are salts such as sodium, potassium, rubidium, and cesium phosphates, sodium, potassium, rubidium, and cesium perchlorates, sodium, potassium, rubidium, and cesium carbonates, sodium, potassium, rubidium, and cesium tetrafluoroborates, sodium, potassium, rubidium, and cesium hexafluorophosphates, and the like.

The concentration of electrolyte salts, when used, can vary widely, for example, from about 0.5 percent to about 30 percent or more by weight of the electrolysis medium, but suitable concentrations will often be in the range of about 1.0 percent to about 15 percent by weight or, on a molar basis, often in the range of about 0.1 molar to about 1.0 molar. If, however, it is desired to have all the components in solution, which state is preferred, the amount of electrolyte salt utilized will be no greater than will dissolve in the electrolysis medium.

Depending upon the particular system and anode selected, it may be desirable to employ one or more sequestering agents such as sodium ethylenediamine tetreacetic acid or triethanolamine to sequester metal in the solution. Corrosion inhibitors such as boric acid may also be employed. The use of sequestering agents and corrosion inhibitors and their function are well known in the electrochemistry art.

In an exemplary method of conducting the present process, a solution of the hydroxybenzaldehyde (about 2.0 percent to about 10 percent by weight, or on a molar basis about 0.1 molar to about 0.5 molar) dissolved in aqueous sodium hydroxide (about 2.0 percent to about 30 percent, or on a molar basis, about 0.5 molar to about 7.5 molar, and usually about 5 percent to about 20 percent, or on a molar basis about 1.0 molar to about 5.0 molar) is charged to an undivided electrolytic cell maintained at a temperature between about 20° C. and about 60° C. and having a steel, lead (IV) oxide, noble metal oxide, carbon, or graphite anode and a lead, cadmium, or mercury cathode. Other suitable bases can be employed in the same or similar concentration ranges so long as the base to hydroxybenzaldehyde molar ratio is at least 1:1. An electric current is then impressed on the cell by connecting the anode and cathode to a proper source of direct current with controls to maintain the current density at between about 0.01 and 200 or more milliamperes per square centimeter for a time sufficient to cause reductive coupling of the hydroxybenzaldehyde to the corresponding 1,2-bis(hydroxyphenyl)ethane-1,2-diol, which then is isolated as described hereinbelow.

The process is suited to either batch or continuous operation. In a batch operation, as the hydroxybenzaldehyde is converted, the pH of the solution will rise unless additional hydroxybenzaldehyde is added to the solution. In a continuous process it may be desirable to maintain a fairly constant pH by adding hydroxybenzaldehyde at substantially the same rate at which the hydroxybenzaldehyde is being depleted in the electrolytic reduction. Filtration of the solution and the precipitate may be accomplished continuously or intermittently.

EXAMPLES 1–5 (semi-continuous)

An electrolyte was prepared having the following constituency.

1050 g 10% $Na_2HPO_4$ solution
1050 g water
48 g boric acid
19 g of a 38 wt % solution of sodium ethylene diamine tetraacetic acid
2 g triethanolamine
240 g p-hydroxybenzaldehyde The solution was adjusted to a pH of 9 with a 50% sodium hydroxide solution. 700 cc of the electrolyte was charged to a container holding a cadmium cathode and a carbon steel anode, each having a surface area of 32 sq. centimeters and spaced at about 6 mm apart. Electrolysis was carried out at 4.5 amperes with cell voltage at about 5 volts for 2 hours. The electrolyte was filtered to remove the precipitated product diol and the electrolyte returned to the cell. Measured amounts of p-hydroxybenzaldehyde were added to readjust the pH of the electrolyte solution to 9. The results are as shown at Table I below:

TABLE I

| Ex. | Mass Product Diol Recovered (gm dry) | Aldehyde Added (gm) | Time (hr) |
|---|---|---|---|
| 1 | 6.7 | 18.4 | 2 |
| 2 | 10.1 | 19.0 | 2 |
| 3 | 6.4 | 6.4 | 2 |
| 4 | 5.1 | 25.0 | 2 |
| 5 | 5.1 | — | 2 |

While the above example represents the best mode so far demonstrated, it was conducted in a beaker-type cell and does not purport to represent a developed commercial process with careful selection and/or optimization of cell design, electrode material selection, flow rate, temperature, additives, etc. A relatively low rate of conversion is attributed primarily to build-up of a by-product, p-hydroxybenzyl alcohol, which acts as a solvent for the product diol. Any commercial process would of course be developed so as to avoid by-product formation.

EXAMPLES 6–7 (showing typical electrolyte precipitation curves)

Alkaline electrolyte solutions, the first being a product-heavy solution initially containing 7 wt % of 1,2-bis(hydroxyphenyl)ethane-1,2-diol (Example 6) and the second being a product-light aldehyde-heavy starting solution containing about 10 wt % of p-hydroxybenzaldehyde (Example 7) were titrated with glacial acetic acid to show the approximate precipitation curves in an electrolyte solution of the type described. The curves are as shown on the FIGURE. The shaded area between the curves is the pH area within which the electrolyte is maintained in the practice of this invention. The shaded area will vary somewhat in shape as the concentration of the hydroxybenzaldehyde is varied between the working concentration limits of 2–10 wt %.

I claim:

1. In a process for the electrolytic reduction of hydroxybenzaldehyde to produce the corresponding 1,2-bis (hydroxyphenyl)ethane-1,2-diol which comprises electrolyzing in an undivided reaction cell an aqueous electrolyte solution comprising the hydroxybenzaldehyde in water, the aqueous solution being in contact with a cathodic surface having a cathode potential sufficient for electrolytic reduction of the hydroxybenzaldehyde, the improvement comprising maintaining the aqueous electrolyte solution in a pH range in which the 1,2-bis(hydroxyphenyl)ethane-1,2-diol precipitates from the solution and the hydroxybenzaldehyde remains in solution; and filtering the solution and precipitate thereby to collect the 1,2-bis(hydroxyphenyl)ethane-1,2-diol.

2. The process of claim 1 wherein the electrolytic reduction is conducted continuously, and the filtration is continuous.

3. The process of claim 1 wherein the filtration is intermittent.

4. The process of claim 1 wherein the hydroxybenzaldehyde is p-hydroxybenzaldehyde.

5. The process of claim 1 wherein the electrolyte solution is maintained at a pH at which the 1,2-bis(hydroxyphenyl)ethane-1,2-diol precipitates out and the hydroxybenzaldehyde remains in solution by adding fresh hydroxybenzaldehyde at substantially the same rate as the rate at which the hydroxybenzaldehyde is being depleted in electrolytic reduction.

6. In a continuous process for the electrolytic reduction of hydroxybenzaldehydes to produce the corresponding 1,2-bis(hydroxyphenyl)ethane-1,2-diol which comprises electrolyzing in an undivided reaction cell an aqueous electrolyte solution comprising the hydroxybenzaldehyde in water, the aqueous solution being in contact with a cathodic surface having a cathode potential sufficient for electrolytic reduction of the hydroxybenzaldehyde, the improvement comprising maintaining the aqueous electrolyte solution at a concentration range of the hydroxybenzaldehyde at about 2–10% and in a pH range in which the 1,2-bis(hydroxyphenyl)ethane-1,2-diol precipitates from the solution and the hydroxybenzaldehyde remains in solution by continually adding hydroxybenzaldehyde at substantially the same rate at which the hydroxybenzaldehyde is being depleted in the electrolytic reduction reaction, and filtering the solution and precipitate thereby to collect the 1,2-bis(hydroxyphenyl)-ethane-1,2-diol.

7. The process of claim 6 wherein the hydroxybenzaldehyde is p-hydroxybenzaldehyde.

* * * * *